US007997920B1

(12) United States Patent
Sun et al.

(10) Patent No.: US 7,997,920 B1
(45) Date of Patent: Aug. 16, 2011

(54) ELECTRICAL CONNECTOR

(75) Inventors: Dao-Rui Sun, Guang-Dong (CN); Feng Zhu, Guang-Dong (CN); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/833,813

(22) Filed: Jul. 9, 2010

(51) Int. Cl.
*H01R 13/625* (2006.01)

(52) U.S. Cl. ..... 439/345; 439/607.56

(58) Field of Classification Search ..... 439/345, 439/347, 352, 353, 357, 358, 607.56
See application file for complete search history.

(56) References Cited

U.S. PATENT DOCUMENTS 5,660,558 A * 8/1997 Osanai et al. ..... 439/353
6,257,914 B1 * 7/2001 Comerci et al. ..... 439/357
6,971,915 B1 * 12/2005 Mao et al. ..... 439/607.37
D620,442 S * 7/2010 Sun et al. ..... D13/147
D627,734 S * 11/2010 Sun et al. ..... D13/147
7,883,369 B1 * 2/2011 Sun et al. ..... 439/607.35
2010/0075526 A1 * 3/2010 Chiu et al. ..... 439/345
* cited by examiner

*Primary Examiner* — James Harvey
(74) *Attorney, Agent, or Firm* — Cheng-Ju Chiang

(57) ABSTRACT

An electrical connector includes a plug connector, a receptacle connector and a locking element. The plug connector includes an insulating housing, a plurality of terminals mounted into the insulating housing, a shell wrapping the insulating housing. The locking element fixed on the plug connector has a top plate, two opposite sides of the top plate are extended downwards to form a pair of locking plates. A front side of the locking element is extended perpendicularly and outwardly to form at least one connecting arm. A top side of the connecting arm is extended frontward to form a locking arm. The locking arm has a front end extended perpendicularly to form a locking end. When the plug connector is inserted into the receptacle connector, the locking element hooks locking potions provided by the receptacle connector to ensure the connection stability between the plug connector and the receptacle connector.

16 Claims, 5 Drawing Sheets

ELECTRICAL CONNECTOR

BACKGROUND OF THE INVENTION

1. Field of the Invention

The present invention generally relates to a connector, and more particularly to an electrical connector capable of connecting a plug connector thereof with a receptacle connector thereof firmly.

2. The Related Art

A conventional electrical connector includes a plug connector and a receptacle connector. The receptacle connector has a receiving chamber, with a plurality of receptacle terminals mounted therein. The plug connector has an insertion portion, with a plurality of plug terminals mounted thereon. The insertion portion is inserted into the receiving chamber so that the plug terminals electrically can connect with the receptacle terminals for transmitting electrical signals. However, the engagement between the plug connector and the receptacle connector may be unsteady once an external force is applied on the plug connector. So, it is desirable to provide a mechanism which can assure that the plug connector is connected with the receptacle connector steadily.

SUMMARY OF THE INVENTION

An object of the present invention is to provide an electrical connector including a plug connector, a receptacle connector and a locking element. The receptacle shell has a rear side bent outwards to form at least one locking portion. The locking element fixed on the plug connector has a top plate, two opposite sides of the top plate are extended downwards to form a pair of locking plates. A front side of the locking element is extended perpendicularly and outwardly to form at least one connecting arm. A top side of the connecting arm is extended frontward to form a locking arm. The locking arm has a front end extended perpendicularly to form a locking end. The locking end hooks the locking portion after the plug connector is inserted into the receptacle connector, for connecting the plug connector with the receptacle connector firmly.

Another object of the present invention is to provide an electrical connector including a plug connector, a receptacle connector and a locking element. The plug connector has an insulating housing and a plurality of terminals mounted into the insulating housing. The insulating housing has a rectangular base, the base has a receiving recess at a front surface thereof. The receptacle connector has a printed circuit board. The printed circuit board has a pair of open fixing grooves at a front thereof, the fixing grooves extend along a front-to-rear direction and are arranged side by side, with a tongue formed therebetween, corresponding to the receiving recess of the insulating housing. A plurality of contacts is formed on the tongue. The receptacle shell is fixed to the printed circuit board and has a pair of side plates restrained in the fixing grooves, the side plates have two front edges bent opposite to each other to form locking portions of strip shape. The locking element fixed to the plug connector has a top plate, two opposite sides of the top plate are extended downwards to form a pair of locking plates, a front end of each locking plate is extended outwardly to form a connecting arm, a top side of the connecting arm is extended frontward to form a locking arm, two adjacent sides of the two locking arms have front ends extended towards each other to form locking ends, the locking ends hook the locking portions after the plug connector is inserted into the receptacle shell, for connecting the plug connector with the receptacle connector firmly.

As described above, the locking element fixed on the plug connector is provided with locking ends to hook the locking potions, which is effective and excellent to assure the connection stability between the plug connector and the receptacle connector.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
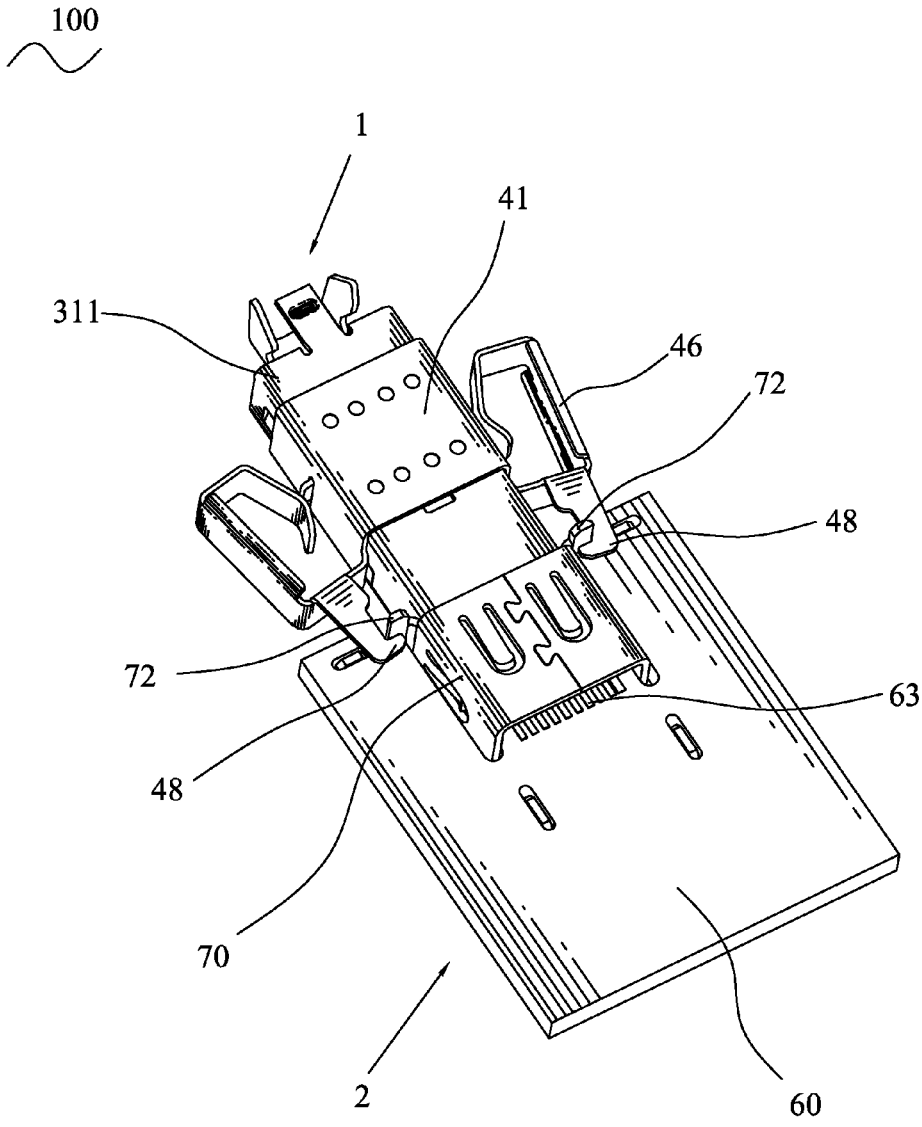
FIG. 1 is an assembled, perspective view of an electrical connector of an embodiment in accordance with the present invention.
Figure 2:
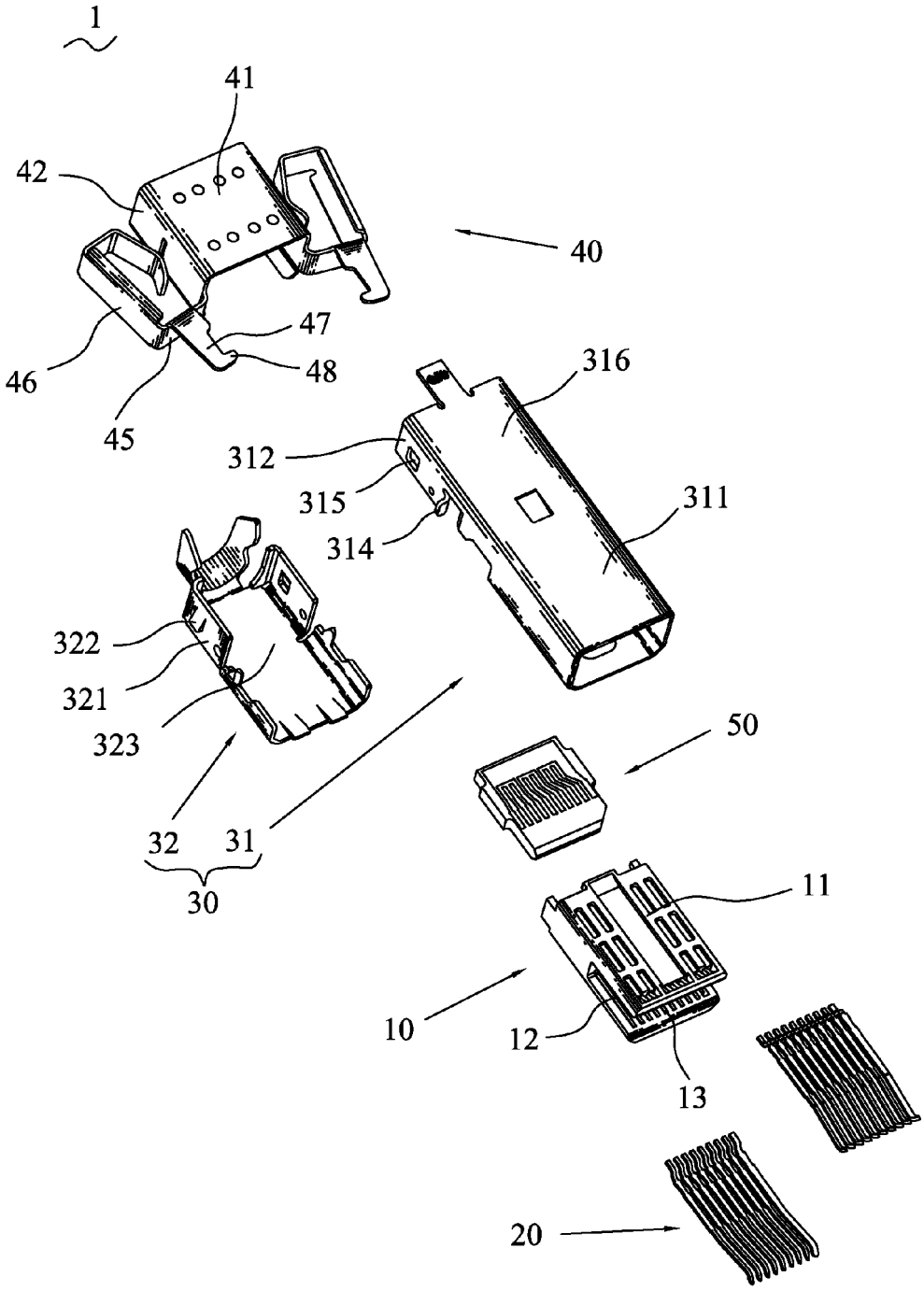
FIG. 2 is an exploded view of a plug connector of the electrical connector shown in FIG. 1.

Referring to the drawings in greater detail, and first to FIGS. 1-2, the embodiment of the invention is embodied in an electrical connector 100. The electrical connector 100 comprises a receptacle connector 2, a plug connector 1 inserted into the receptacle connector 2, and a locking element 40 fixed on the plug connector 1 to fix the plug connector 1 to the receptacle connector 2.

With reference to FIG. 2, the plug connector 1 comprises an insulating housing 10, a plurality of terminals 20 mounted in the insulating housing 10, a first circuit board 50 fixed on a rear end of the insulating housing 10, and a shell 30 wrapping the insulating housing 10 and the first circuit board 50. The insulating housing 10 has a substantially rectangular base 11. The base 11 has a receiving recess 12 at a front surface thereof and extending through two opposite sides thereof. A plurality of terminal grooves 13 is formed at a bottom side and a top side of the receiving recess 12. The terminal grooves 13 extend frontward and rearwards and pass through the whole insulating housing 10 for receiving the terminals 20.

The shell 30 has a first shell 31 and a second shell 32. The first shell 31 has a casing 311 of rectangular frame shape for wrapping the base 11, a covering plate 316 extending rearwards from a rear edge of a top plate of the casing 311, and a pair of lateral plates 312 extending downwards from two opposite sides of the covering plate 316. Each of the lateral plates 312 is spaced away from the casing 311, and has a front end bent outwards to form a fixing piece 314. A rear portion of the lateral plate 312 is formed with a mating opening 315. The second shell 32 has a bottom plate 323, corresponding to the covering plate 316. Two opposite sides of the bottom plate 323 have rear portions extended upwards to form a pair of lateral slices 321. Each of the lateral slices 321 is punched outwards to form a buckling piece 322, slanting outside and downwardly, for buckling with the corresponding mating opening 315 to fix the first shell 31 and the second shell 32 together.

Figure 3:
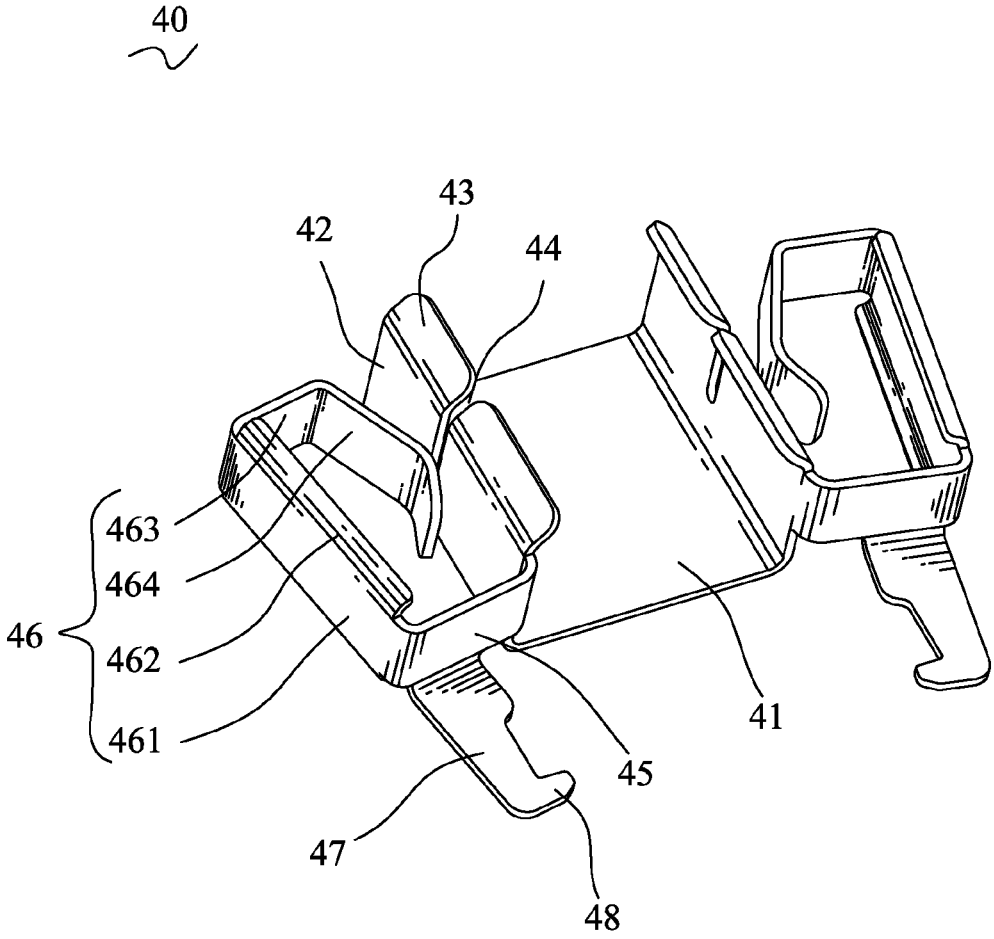
FIG. 3 is a perspective view of a locking element of the receptacle connector shown in FIG. 2.
Figure 5:
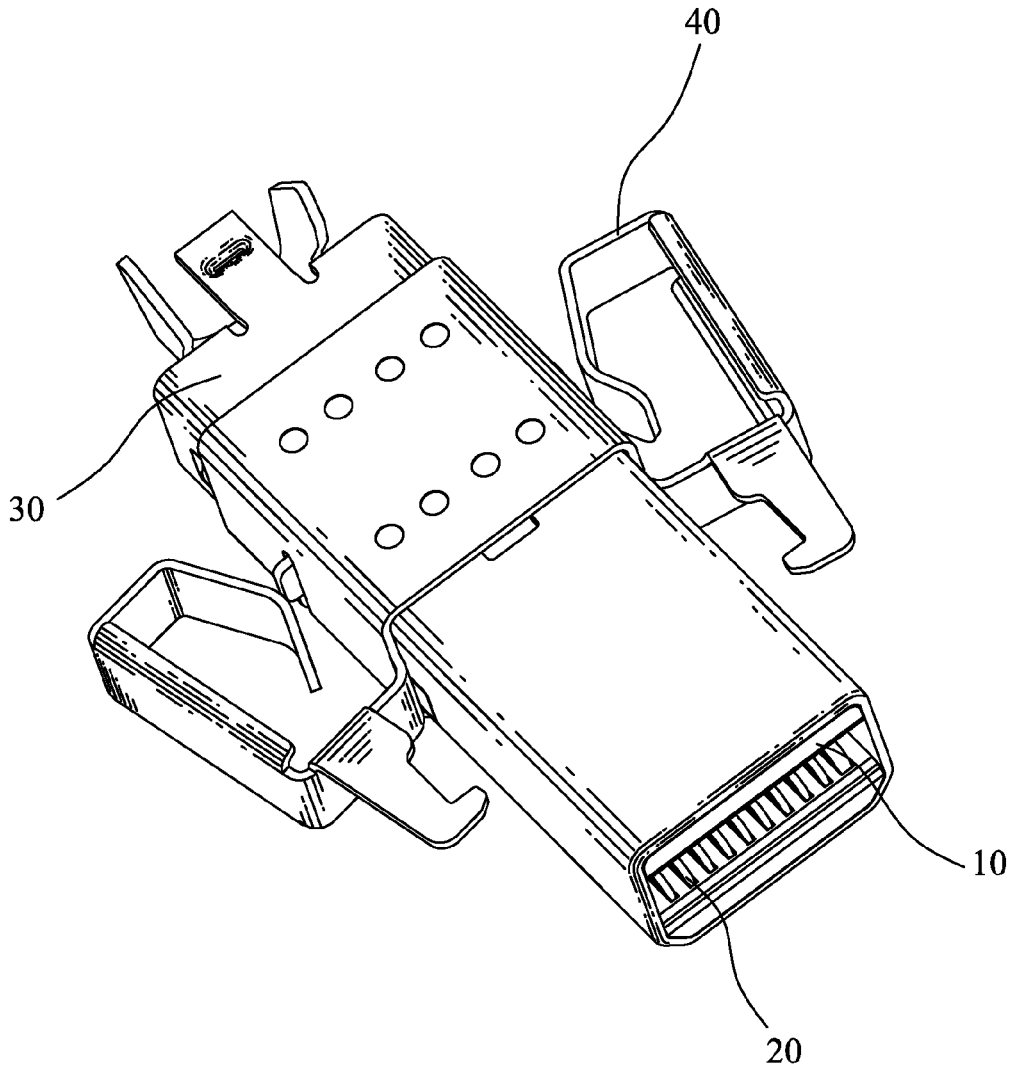
FIG. 5 is an assembled, perspective view of the plug connector of the electrical connector shown in FIG. 1.

Please refer to FIGS. 2-3 and FIG. 5, the locking element 40 made of metal material has a rectangular top plate 41 attached to the covering plate 316. In this embodiment, the top plate 41 is fixed on the covering plate 316 by means of ultrasonic soldering. Two opposite sides of the top plate 41 extend downwards to form a pair of locking plates 42. Each of the locking plates 42 has a buckling recess 44 at a substantially middle portion thereof. The buckling recess 44 extends upward and downwards, for receiving the fixing piece 314 to prevent the locking element 40 from moving frontward and rearwards with respect to the first shell 31. A bottom side of the locking plate 42 is bent inwards to form a clasping slice 43 which clasps a bottom side of the shell 30 in assembly. A front end of the locking plate 42 extends perpendicularly and outwardly to form a connecting arm 45. The connecting arm 45 connects with an elastic arm 46. The elastic arm 46 has a rectangular basic section 461 which is extended rearwards from a free end of the connecting arm 45, a transition section 463 which is extended toward the locking plate 42 from a free end of the basic section 461, and an elastic section 464 extended from a free end of the transition section 463. A bottom edge of the basic section 461 is slanted toward the locking plate 42 to form a transition piece 462. The elastic section 464 is substantially V-shape, with an apex thereof resting against the locking plate 42. A top side of each connecting arm 45 is extended frontward to form a locking arm 47, adjacent to the basic section 461. Two adjacent sides of the two locking arms 47 have front ends extended toward each other to form locking ends 48. The locking arm 47 and the locking end 48 cooperatively form a substantially L shape.

Figure 4:
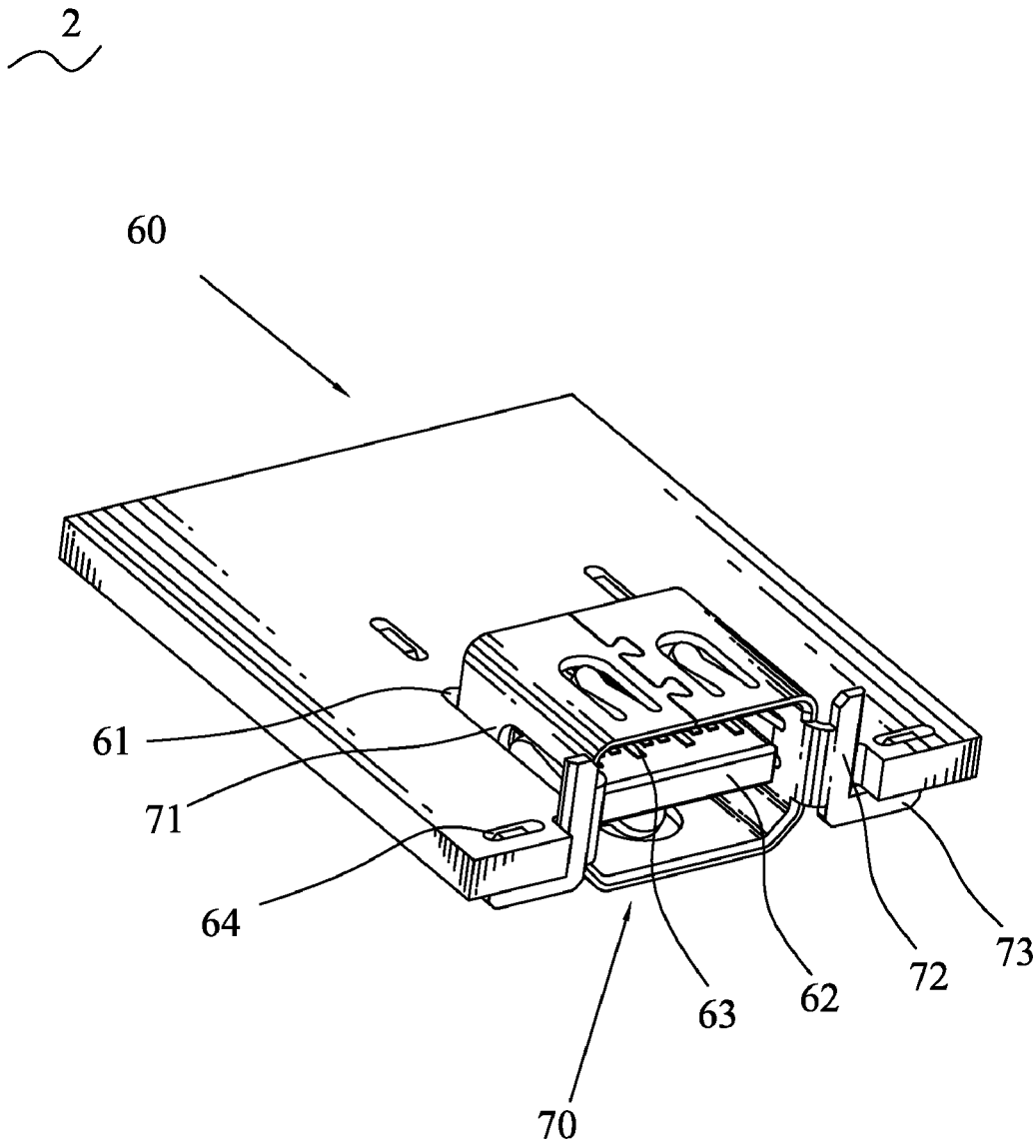
FIG. 4 is a perspective view of a receptacle connector of the electrical connector shown in FIG. 1.

Please refer to FIG. 4, the receptacle connector 2 receiving the plug connector 1 comprises a second printed circuit board 60 and a receptacle shell 70. The second printed circuit board 60 has a pair of open fixing grooves 61 at a rear portion thereof. The fixing grooves 61 extend along a front-to-rear direction and are arranged side by side, with a tongue 62 formed therebetween. A plurality of contacts 63 is mounted on the tongue 62 along a front-to-rear direction. A pair of slits 64 is formed at a rear portion of the second printed circuit board 60. The slit 64 extends in a direction perpendicular to the front-to-rear direction and is spaced from the corresponding fixing groove 61 with a predetermined distance. The receptacle shell 70 is substantially a rectangular frame shape, and defines a pair of side plates 71 restrained in the fixing grooves 61. The side plates 71 have two rear edges bends opposite to each other to form locking portions 72. The locking portion 72 is of strip shape and extends upward and downwards. A lower end of the locking portion 72 is extended opposite to the side plate 71 to form a holding portion 73 of inverted-L shape, with a leg extending upwards being received in the corresponding slit 64 for fixing the receptacle shell 70 to the second printed circuit board 60.

Referring to FIG. 1, in assembly, while the plug connector 1 is inserted into the receptacle connector 2, the basic sections 461 are held to approach each other, so that the elastic sections 464 are deformed resiliently and the locking arms 47 apart from each other. The locking ends 48 hook the locking portions 72 after the basic sections 461 are released and the elastic sections 464 restore resiliently, thereby securing the plug connector 1 and the receptacle connector 2.

As described above, the locking element 40 fixed on the plug connector 1 is provided with the locking ends 48 to hook the locking potions 72, which is effective and excellent to assure the connection stability between the plug connector 1 and the receptacle connector 2. The elastic arms 46 is adapted for facilitating the engagement between the locking ends 48 and the locking potions 72, meanwhile, provides elastic force for guaranteeing the locking ends 48 to hook the locking potions 72 firmly. In addition, it is comfortable to hold the basic sections 461 with the transition piece 462 formed thereon.

What is claimed is:

1. An electrical connector having a receptacle connector having a receptacle shell, the receptacle shell having a rear side bent outwards to form at least one locking portion, comprising:

a plug connector; and a locking element fixed on the plug connector having a top plate, two opposite sides of the top plate extended downwards to form a pair of locking plates, a front side of the locking element extended outwardly to form at least one connecting arm, a top side of the connecting arm extended frontward to form a locking arm, the locking arm having a front end extended inwardly to form a locking end, the locking end hooking the locking portion after the plug connector is inserted into the receptacle connector, for connecting the plug connector with the receptacle connector firmly.

2. The electrical connector as claimed in claim 1, wherein the plug connector has a first shell and a second shell, the first shell has a casing surrounding an insulating housing of the plug connector, a rear end of the casing is extended rearwards to form a covering plate, two opposite sides of the covering plate are extended downwards to form a pair of lateral plates secured to the insulating housing.

3. The electrical connector as claimed in claim 2, wherein each of the lateral plates has a front end bent outwards to form a fixing piece, each locking plate has a buckling recess, corresponding to the fixing piece, for fixing the locking element to the plug connector.

4. The electrical connector as claimed in claim 2, wherein the second shell has a bottom plate corresponding to the covering plate, two opposite sides of the bottom plate are extended upwards to form a pair of lateral slices, each of the lateral slices has a buckling piece mating with a mating opening formed at the lateral plate of the first shell.

5. The electrical connector as claimed in claim 1, wherein the locking element is fixed on a shell of the plug connector by means of ultrasonic soldering.

6. The electrical connector as claimed in claim 1, wherein the locking element has a basic section extended rearwards from a free end of the connecting arm and spaced away from the corresponding locking plate.

7. The electrical connector as claimed in claim 6, wherein the basic section has a free end extended toward the locking plate to form a transition section, the transition section has a free end extending forwards to form an elastic section, the elastic section is substantially smooth V-shape, with an apex thereof resting against the locking plate.

8. The electrical connector as claimed in claim 6, wherein a top edge of the basic section is slanted toward the locking plate to form a transition piece for facilitating the hold.

9. The electrical connector as claimed in claim 1, wherein a bottom side of the locking plate extends inwards to form a clasping slice for clasping a bottom of the plug connector.

10. The electrical connector as claimed in claim 1, wherein the locking arm and the locking end form a substantially L shape.

11. The electrical connector as claimed in claim 1, wherein front ends of the two locking plates are extended outwardly to form two connecting arms, respectively, accordingly, two locking arms and locking ends are formed for hooking the corresponding locking portions which are bent opposite to each other from a pair of side plates of the receptacle shell.

12. An electrical connector, comprising:

a plug connector comprising:

an insulating housing having a rectangular base, the base having a receiving recess at a front surface thereof; and a plurality of terminals mounted into the insulating housing;

a receptacle connector comprising:

a printed circuit board having a pair of open fixing grooves at a rear thereof, the fixing grooves extending along a front-to-rear direction and arranged side by side, with a tongue formed therebetween, corresponding to the receiving recess of the insulating housing;

a plurality of contacts formed on the tongue; and a receptacle shell fixed to the printed circuit board and having a pair of side plates restrained in the fixing grooves, the side plates having two front edges bent opposite to each other to form locking portions of strip shape; and a locking element fixed to the plug connector having a top plate, two opposite sides of the top plate extended downwards to form a pair of locking plates, a front end of each locking plate extended outwardly to form a connecting arm, a top side of the connecting arm extended frontward to form a locking arm, two adjacent sides of the two locking arms having front ends extended towards each other to form locking ends, the locking ends hooking the locking portions after the plug connector is inserted into the receptacle shell, for connecting the plug connector with the receptacle connector firmly.

13. The electrical connector as claimed in claim 12, wherein the plug connector further comprises a shell wrapping the base, the locking element is attached to an outside of the shell.

14. The electrical connector as claimed in claim 12, wherein the locking element has a basic section extended rearwards from a free end of the connecting arm and spaced away from the corresponding locking plate.

15. The electrical connector as claimed in claim 14, wherein the basic section has a free end extended toward the locking plate to form a transition section, the transition section has a free end extending forwards to form an elastic section, the elastic section is substantially smooth V-shape, with an apex thereof resting against the locking plate.

16. The electrical connector as claimed in claim 15, wherein a top edge of the basic section is slanted toward the locking plate to form a transition piece for facilitating the hold.

* * * * *